US007654590B2

(12) United States Patent
Hapke

(10) Patent No.: US 7,654,590 B2
(45) Date of Patent: Feb. 2, 2010

(54) MAGNETIC APPLIANCE LATCH

(75) Inventor: Kenyon A. Hapke, Libertyville, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 262 days.

(21) Appl. No.: 11/325,162

(22) Filed: Jan. 4, 2006

(65) Prior Publication Data

US 2006/0145485 A1 Jul. 6, 2006

Related U.S. Application Data

(60) Provisional application No. 60/641,536, filed on Jan. 4, 2005.

(51) Int. Cl.
*E05C 17/56* (2006.01)

(52) U.S. Cl. ..... 292/251.5; 292/DIG. 69; 134/57 DL; 134/58 DL

(58) Field of Classification Search ..... 292/341.16, 292/251.5, DIG. 69; 312/296, 228, 229, 312/311; 134/57 DL, 58 DL
See application file for complete search history.

(56) References Cited

U.S. PATENT DOCUMENTS

| | | | | |
|---|---|---|---|---|
| 2,471,635 | A * | 5/1949 | Mark et al. | 49/478.1 |
| RE23,636 | E * | 3/1953 | Mark | 49/478.1 |
| 2,871,676 | A * | 2/1959 | Miller et al. | 62/264 |
| 2,891,560 | A | 6/1959 | Ullman, Jr. et al. | |
| 3,647,165 | A * | 3/1972 | Whitla | 244/118.5 |
| 3,985,023 | A | 10/1976 | Guth | |
| 4,951,693 | A | 8/1990 | Archambault | |
| 5,293,020 | A | 3/1994 | Han et al. | |
| RE35,268 | E * | 6/1996 | Frolov et al. | 340/545.2 |
| 5,881,746 | A | 3/1999 | Buser et al. | |
| 6,489,871 | B1 * | 12/2002 | Barton | 335/285 |
| 6,609,738 | B1 * | 8/2003 | Roth et al. | 292/251.5 |
| 6,740,834 | B2 * | 5/2004 | Sueyoshi et al. | 200/600 |
| 6,811,236 | B1 | 11/2004 | Spong et al. | |
| 2004/0031660 | A1 * | 2/2004 | Kliemannel | 192/220.4 |
| 2004/0163684 | A1 * | 8/2004 | Hapke | 134/57 DL |

FOREIGN PATENT DOCUMENTS

| | | |
|---|---|---|
| EP | 1 605 332 | 12/2005 |
| WO | WO 01/92981 | 12/2001 |

* cited by examiner

*Primary Examiner*—Gary Estremsky
(74) *Attorney, Agent, or Firm*—Boyle Fredrickson, S.C.

(57) ABSTRACT

An electrically operable door latch employs a permanent magnet for retaining an appliance door closed against the force of a resilient seal. An electromagnet bucks the magnetic attraction of the permanent magnet allowing the latch to be electronically releasable. A simple mechanism and inherent force limits are obtained by a direct magnetic attraction between a strike plate and the latch, one on the door and one on the housing.

18 Claims, 3 Drawing Sheets

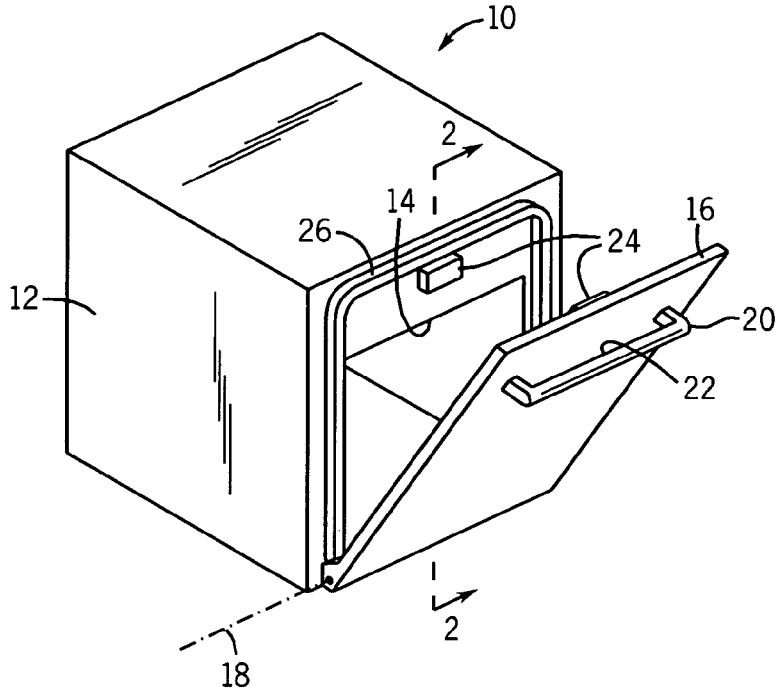
FIG. 1
FIG. 2
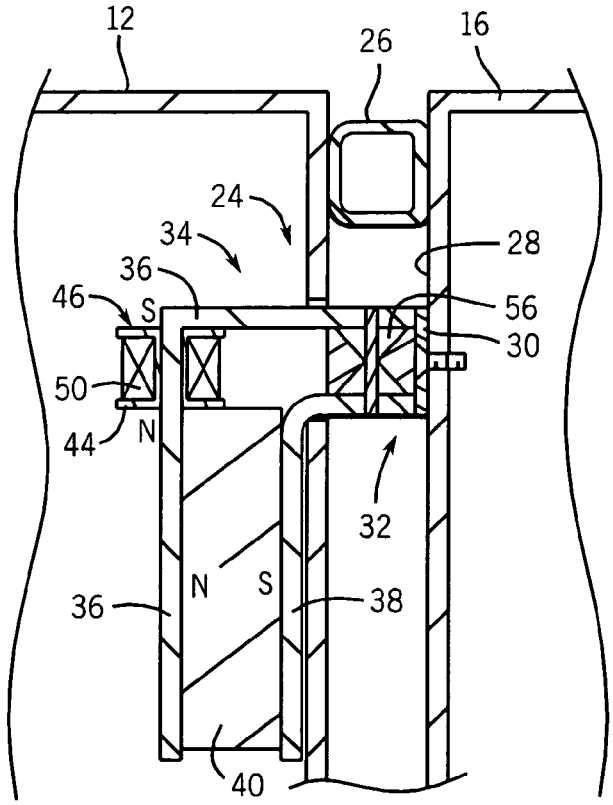

MAGNETIC APPLIANCE LATCH

CROSS-REFERENCE TO RELATED APPLICATIONS

This application claims the benefit of U.S. Provisional Application 60/641,536 filed Jan. 4, 2005, hereby incorporated by reference.

BACKGROUND OF THE INVENTION

The present invention relates generally to appliances such as dishwashing machines and more specifically to a door latch for such appliances.

A residential dishwasher may provide a washing chamber holding racks into which soiled dishes may be placed. A door may close the chamber and may include a gasket sealing the door against the leakage of hot water sprayed on the dishes during the washing process.

In order to hold the gasket properly compressed, the door may have a latch assembly, for example, a hook interconnecting the housing and door and lever system for providing mechanical advantage to compress the gasket when the lever is moved. Such latch systems are complicated and can be expensive to manufacture and cumbersome to use.

BRIEF SUMMARY OF THE INVENTION

In a first embodiment, the present invention is an extremely simple magnetic latch for a dishwasher, holding the door of the dishwasher closed with the seal compressed. The magnetic latch includes a ferromagnetic strike plate attached to one of the housing and door, and a magnetic attractor having a pole piece communicating with a permanent magnet attached to the other of the housing and door in a form analogous to a "cabinet latch". The magnet is sized to hold the door closed against a predetermined force of opening and the compression of the elastomeric seal.

Thus, it is one object of at least one embodiment of the invention to provide an extremely simple latch for a dishwasher having few or no moving parts which can nevertheless provide the force necessary to hold the elastomeric seal on a dishwasher door compressed against leakage. The elastic force of the gasket offsets a portion of the magnetic attraction of the latch, making manual opening of the latch practical. It is therefore another object of at least one embodiment of the invention to provide a latch that may be manually opened at any time, or during any part of the dishwashing cycle, by the simple and intuitive action of pulling on the door.

In a different embodiment, the latch further includes an electromagnet communicating with the pole face to counteract the permanent magnet and release the ferromagnetic strike from the pole face when the electromagnet is energized.

It is thus another object of at least one embodiment of the invention to provide a latch for an appliance allowing electronic release of the latch.

The latch may include a spring bias element biasing the door away from the housing so that the door moves away from the housing after the door is closed, retained, and then released.

Thus, it is another object of at least one embodiment of the invention to provide a latch that may be used to electronically open the door during a drying phase of a dishwasher cycle under the control of a cycle timer or manually operated switch.

The spring may be an elastomeric seal positioned between the door and housing.

Thus, it is another object of at least one embodiment of the invention to make dual use of the seal in providing a visible indication to the user when the door is unlatched as the seal pushes the door outward.

The latch may include latch control circuitry providing a pulse to the electromagnet or multiple pulses to release the door upon receipt by the latch control circuitry of a release signal.

Thus, it is another object of at least one embodiment of the invention to allow for electronic control of the latch that minimizes heating in the electromagnet, and thus the necessary size of the electromagnet while providing an extended unlatched period.

The latch may include a user operable handle for energizing the electromagnet upon activation of the handle by a user.

It is therefore one object of at least one embodiment of the invention to provide for a low force release of the latch.

The handle may be activated by movement of the handle to activate an electronic switch.

Thus, it is an object of at least one embodiment of the invention to provide a simple mechanism of incorporating the latch of the present invention into conventional dishwashers or other appliances having moving handles.

Alternatively, the handle may be activated by a grasping of the handle by a user and a sensing of the grasping. The sensing of the grasping may be, for example, capacitive or inductance detectors or those relying on a change of conductivity or light when the hand is in position to grasp the handle.

It is thus another object of at least one embodiment of the invention to provide an unlocking of the appliance door without the need to exert an unlatching force on the handle by a user.

The latch may include a motorized door closure mechanism attached to one of the housing in the door between the housing and the door and one of the ferromagnetic strike and pole face. The motorized door closure mechanism may receive a motor signal to move the door when the pole face is magnetically retained by the ferromagnetic strike against the pole face.

Thus, it is one object of at least one embodiment of the invention to provide a latch that is particularly well suited for a motorized door closure. The latch provides an extremely simple mechanism for holding the door to the motorized door closure mechanism, and yet one which releases under the force of an obstacle in the door or with a strong tug by a user in the event of a power failure.

The motorized door closure mechanism may include a force sensor and the electromagnet may be energized by the motorized door closure mechanism when a force of predetermined magnitude is sensed.

Thus, it is another object of at least one embodiment of the invention to provide an arbitrary threshold force at which the door will release as may be desired in an automatic door closing system.

At least one of the pole face and ferromagnetic strike may be attached by a gimbal to a respective door and housing.

Thus, it is another object of at least one embodiment of the invention to provide a latch that may accommodate manufacturing tolerance and wear of the dishwasher door.

The pole face may comprise at least one L-shaped pole having a first leg aligned with an axis of closing of the door to the housing and the second leg perpendicular thereto along which the permanent magnet and electromagnet are arrayed.

It is thus another object of at least one embodiment of the invention to provide a latch construction that may fit within the restricted axial depth of the housing and doors. It is another object of the invention to provide good magnetic linkage between the permanent magnet and electromagnet reducing the size of the electromagnet.

The present invention provides in one embodiment a dishwasher having an electronically controlled latch holding the door when the latch is in a first state and releasing the door when the latch is in a second state, and a motorized actuator communicating with the electronically controllable latch to move between a first position holding the door closed when the door is held by the electronically controllable latch, and a second position when the door is held partially open when the door is held by the electrically controllable latch. A door bias element may move the door from the second position to a third position further open than the second position when the electrically controllable latch is released.

Thus it is another object of at least one embodiment of the invention to provide a dishwasher whose door may be closed manually from a venting position to a point at which the latch may engage, and then be pulled in mechanically against the force of the seal. At least one of the first and second positions may provide for venting of the dishwasher.

Thus, it is another object of at least one embodiment of the invention to provide improved venting of a dishwasher.

These particular objects and advantages may apply to only some embodiments falling within the claims and thus do not define the scope of the invention.

BRIEF DESCRIPTION OF THE DRAWINGS

FIG. 1 is a simplified perspective view of a dishwasher that may use the present invention showing a door opening about a washing chamber;

FIG. 2 is a cross-sectional fragmentary view of the upper edges of the door and washing chamber of FIG. 1 taken along lines 2-2 showing a positioning of the magnetic latch between the door and housing of the dishwasher per one embodiment of the present invention when the door is in a sealed position;

DETAILED DESCRIPTION OF THE PREFERRED EMBODIMENT

Figure 3:
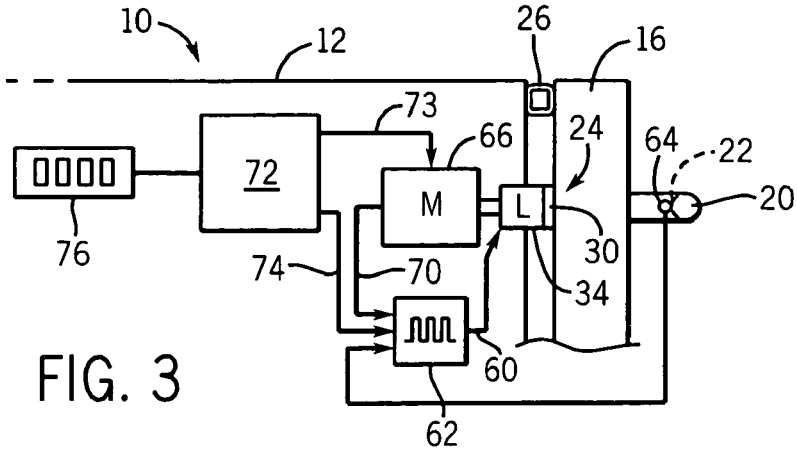
FIG. 3 is a block diagram showing use of the latch of FIG. 2 with a motorized door closing mechanism and the control thereof.

Referring now to FIG. 1, an appliance such as a dishwasher 10 includes a housing 12 having an opening 14 that may be closed by means of a door 16. The door may hinge about a hinge axis 18 along its lower edge and may have a handle 20 on its front face. The handle, for example, may be a C-shaped bar of metal providing for a horizontal grasping surface 22.

Referring to FIGS. 1 and 2, a latch 24 may be positioned between the door 16 and housing 12 to hold the door 16 against the housing 12 so as to seal the opening 14 by compression of interposed elastomeric seal 26 between the door 16 and the housing 12.

An inner wall 28 of the door 16 may have a ferromagnetic strike plate 30 attached thereto. When the door is fully closed with the seal 26 compressed, the strike plate 30 may abut a pole face 32 of a magnetic attractor 34 of the present invention to be held there against the opening force of the compressed seal 26. It will be understood that the positioning of the magnetic attractor 34 and strike plate 30 may be reversed.

Figure 4:
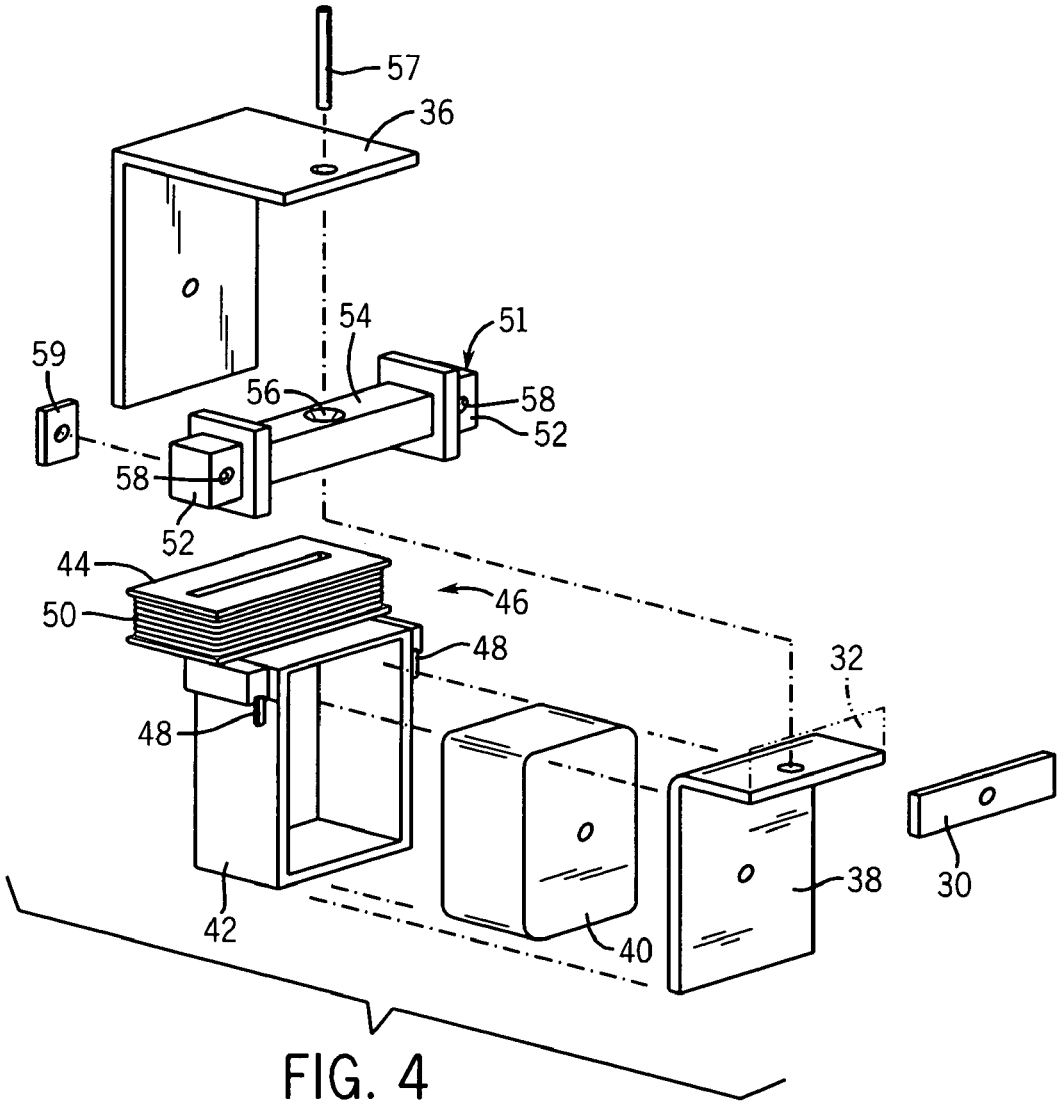
FIG. 4 is an exploded perspective view of the latch of FIG. 2 showing the alignment of a permanent magnet and electromagnet along flanking pole pieces.

Referring to FIGS. 2 and 4, the magnetic attractor 34 may include upper and lower pole pieces 36 and 38, respectively, each being L-shaped with horizontally extending upper legs whose ends align to define the pole face 32 and with vertically extending lower legs passing downward within the housing 12.

The vertically extending lower legs of the pole pieces 36 and 38 may sandwich a permanent magnet 40 with a vertically extending lower leg of pole piece 36 abutting rear (north pole) of the permanent magnet 40 and vertically extending lower legs of pole piece 38 abutting front (south pole) of the permanent magnet 40. It will be understood from the following description that the polarities of the permanent magnet 40 may be reversed with appropriate changes in current flow through the electromagnet described below.

The permanent magnet 40 may be supported by plastic magnet frame 42 (not shown in FIG. 2) supporting the edges of permanent magnet 40 while exposing its north and south poles to abut the pole pieces 36 and 38. The magnet frame holds on its top surface a bobbin 44 wound with wire 50 to create an electromagnet 46. The electromagnet 46 is vertically oriented having its coil wound around pole piece 36 above magnet 40. Thus the electromagnet 46 when energized defines a vertically oriented magnetic axis passing between north and south poles in contrast to the permanent magnet 40 which has a horizontal magnetic axis.

The bobbin includes terminals 48 connected to wire 50 of the electromagnet 46 that may be energized with a DC current so as to create a north and south pole of the electromagnet 46 that counters the magnetism of the permanent magnet 40. In this case, the electromagnet 46 will be energized so that its south pole will be at the top of the bobbin 44 near pole face 32, and its north pole will be at the bottom of the bobbin 44 near permanent magnet 40.

It will be understood that when the electromagnet 46 is properly energized, the field from the permanent magnet 40 may be counteracted causing a release of magnetic attraction between pole face 32 and strike plate 30.

Referring still to FIGS. 2 and 4, the magnetic attractor 34 may be held on the housing 12 by means of a support bar 51 having outer ends 52 flanking a center section 54. Ends 52 may attach to a face 59 of the housing 12 by means of screws (not shown) passing through holes 58. The center section 54 may have an hourglass-shaped hole 56 extending vertically there through and may fit between the horizontally extending upper legs of pole pieces 36 and 38 near pole face 32 to be retained by a vertical drive pin 57 passing through horizontally extending upper legs of pole pieces 36 and 38, and through the hourglass shaped hole 56 in the center section 54.

The shape of the hourglass-shaped hole 56 allows gimbaling of the magnetic attractor 34 with respect to the housing 12 so that the pole face 32 may accurately align with the surface of the ferromagnetic strike plate 30 to provide maximum hold-in force when the two abut. The pole pieces 36 and 38 concentrate the magnetic flux of the permanent magnet 40 increasing its force of attraction on the ferromagnetic strike plate 30.

Referring now to FIG. 3, the electromagnet 46 of the magnetic attractor 34 of the present invention may receive a release signal 60 in the form of a set of DC pulses from a latch drive circuit 62 such as are sized to momentarily release the magnetic attraction between the pole face 32 and strike plate 30. The use of pulses over an extended time period limits the heating of the wire 50 of the electromagnet 46 and ensures release of the door 16 in the event that the door is momentarily retained against release, for example, by action of a user.

Optionally, it will be understood that control of the duty cycle of the pulses from latch drive circuit 62 allows moderation of the magnetic force of attraction only so as to create a second threshold of retention force in the event that that may be desired.

Latch drive circuit 62 may be activated by different sources. One source is a proximity sensor 64 that may be positioned on the grasping surface 22 of the handle 20 so that a user grasping the handle 20 may cause a releasing of the latch 24. The proximity sensor 64 may be a simple switch activated by movement of the handle 20, or a proximity sensor sensing the user's hand on the inner surface of the handle 20 such as indicates a desire by the user to pull the door 16 open. The proximity sensor 64 allows the door to be opened with very little force applied by the user despite the need for considerable hold-in force to retain the seal 26 in compression.

The proximity sensor 64 may be any of a variety of sensor types, for example, a capacitive sensor or one that relies on changes of conductivity, inductance, or light incident to the touching of the handle 20 on its inner surface.

By deploying the proximity sensor 64 only on the inner surface of the handle 20, release of the latch 24 will not be caused by a pressing on the outer surface of the handle 20 such as may be used to close the door 16, but the user's intent to open the door may be distinguished.

Alternatively, the signal from the proximity sensor 64 may be gated by latch drive circuit 62 to be informed by the last state of the door 16 as opened or closed. Thus, if the door were previously in an open state, the proximity sensor 64 could be ignored until the door was in a closed state, and then a signal from proximity sensor 64 would cause an opening of the door by releasing of the latch 24.

It will be understood that the proximity sensor 64 may form the entire handle 20 properly isolated from other electrical sources or may be a separate component on the handle.

Referring still to FIG. 3, the magnetic attractor 34 need not be directly attached to the housing 12 (or door 16), but may be indirectly connected to the housing 12 (or door 16) through a motorized actuator 66 such as are described generally in U.S. Patent Application 20040163684 entitled: "Automatic Door For Dishwasher" and assigned to the assignee of the present invention, and hereby incorporated by reference. The motorized actuator 66 generally permits movement of the magnetic attractor 34 inward and outward.

When the motorized actuator 66 is fully extended from the housing 12 and latch 24 is closed (i.e., with magnetic attractor 34 attached to the strike plate 30), the motorized actuator 66 may pull the door 16 further closed against the force of the seal 26. During this pull-in, the motorized actuator 66 may sense a resisting force greater that the force of the seal 26 such as may indicate jamming or a utensil trapped between the door 16 and the housing 12. In this case, the motorized actuator 66 may produce a jam signal 70 causing a release of the magnetic attractor 34 by the latch drive circuit 62. In this context, the motorized actuator 66 may control the latch drive circuit 62 to vary the magnetic force of the latch 24, for example, as a function of how far the door 16 has been closed to increase the pull-in force after the risk of entrapped obstacles is low.

Note that the release of the latch 24 by the latch drive circuit 62 in the event of a jam or obstruction is backstopped by the limited force of attraction between the permanent magnet 40 in attracting strike plate 30. This force, which may be overcome by the user pulling sharply on the handle 20, allows the door to be opened at anytime including during a power failure, and effectively creates a force limit to a closing of the door such as provides for additional safety considerations.

As has been described in the co-pending applications cited above, the motorized actuator 66 may be controlled by a cycle timer 72 for controlling timing of the washing cycle. Cycle timer 72 may receive user commands from a control panel 76 of a type well known in the art.

Figure 5A:
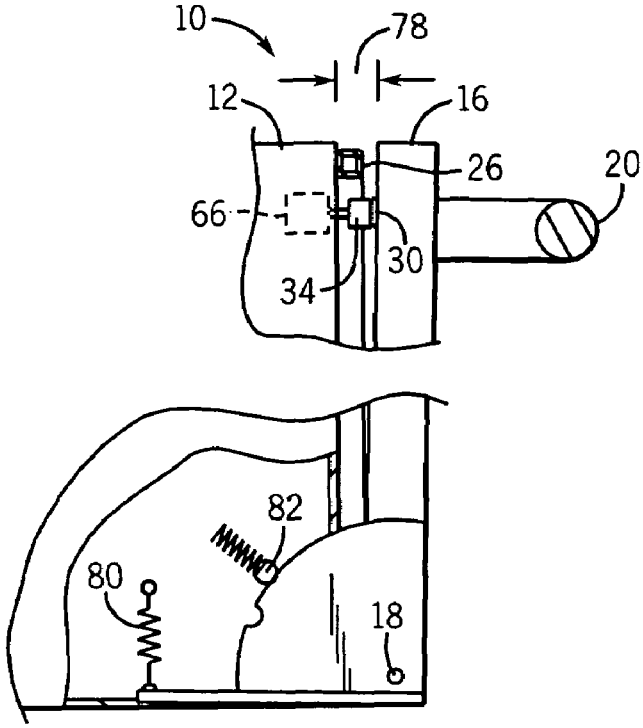
FIG. 5*a* is a figure similar to that of FIG. 2 showing the door in a first venting position when a motorized door opener is used and the latch is retaining the door.

Referring now to FIGS. 3 and 5*a*, upon reaching a drying stage, the cycle timer 72 may produce a door venting signal 73 causing an extension of the motorized actuator 66 to create a gap 78 between the door 16 and housing 12 and around seal 26 that will allow venting of vapor from inside the housing 12. Venting of this type, described in the above-described co-applications, can improve the drying time of the dishes contained in the dishwasher 10.

This venting position may also be used prior to starting of the dishwasher 10 to allow ongoing venting of the chamber of the dishwasher 10 and optionally to tip the door to provide access to the top of door 16 from beneath a counter or the like in cases where the top of the door 16 includes the control panel 76 shown in FIG. 3.

Figure 5B:
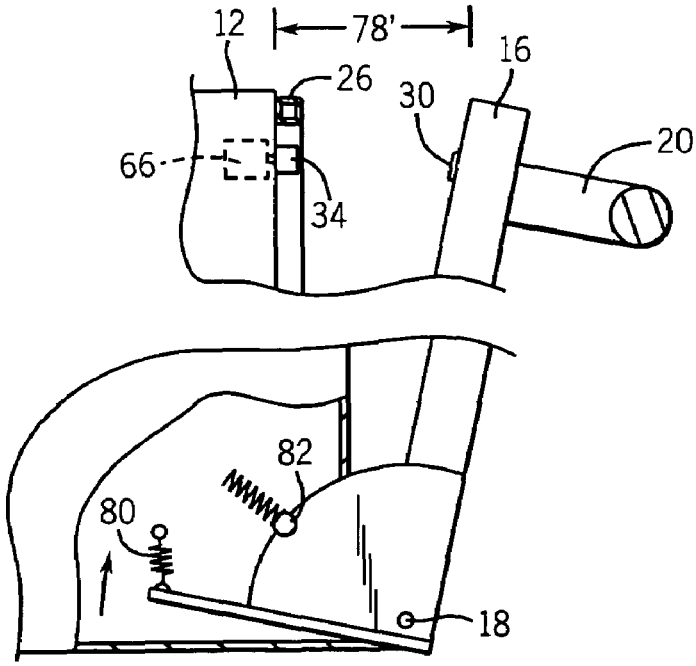
FIG. 5*b* is a figure similar to that of FIGS. 2 and 5*a* showing the door in a second venting position when a motorized door opener is used and the latch is released.

Referring to FIGS. 3 and 5*b*, an increased drying effect may be obtained after the motorized actuator 66 is in full extension as shown in FIG. 5*a*, by releasing magnetic attractor 34 and allowing door 16 to open to second gap 78' being greater than gap 78 as driven by a bias spring 80 as shown in FIG. 5*b*. The bias spring 80 urges the door 16 to an open position where it is releasably restrained by detent 82. Detent 82 stops increased opening of the door 16 beyond gap 78' absent additional manual force by the user.

After drying is complete, the user may pull on the handle 20 to fully open the door 16 for removal and insertion of soiled dishes, then return the door to the position shown in FIG. 5*a* with the motorized actuator 66 used to fully close the door against the seal 26.

It is specifically intended that the present invention not be limited to the embodiments and illustrations contained herein, but include modified forms of those embodiments including portions of the embodiments and combinations of elements of different embodiments as come within the scope of the following claims. For example, pole pieces 36 and 38 need not be 'L' shaped unless required by the physical constraints of the surrounding enclosure.

I claim:

1. A washing appliance comprising:

a door;

an elastomeric compression seal;

a washing chamber closable by the door compressing the elastomeric seal between the door and washing chamber to provide a watertight seal;

a latch holding the door to compress the elastomeric seal between the door and the washing chamber against an opening force exerted on the door by the elastomeric seal, the latch having:

a ferromagnetic strike attached to one of the housing and the door;

a magnetic attractor attached to an other of the housing and door and having a pole face abutting the ferromagnetic strike when the door is closed against the housing;

a permanent magnet magnetically communicating with the pole face to magnetically retain the ferromagnetic strike against the pole face in a first state with a force of magnetic attraction greater than an opening force between the door and washing chamber exerted by the elastomeric compression seal;

an electromagnet magnetically communicating with the pole face to counteract the permanent magnet and release the ferromagnetic strike from the pole face in a second state when the electromagnet is energized;

a user operable door handle attached to the door for opening the door and for energizing the electromagnet upon activation of the handle by a user; and a motorized door closure mechanism attached to one of the housing and the door and to one of the ferromagnetic strike and magnetic attractor to move the one of the ferromagnetic strike and magnetic attractor to an extended position whereby the pole face may be magnetically attached to the ferromagnetic strike before substantial compression of the seal and to move the magnetically attached pole face and ferromagnetic strike to a retracted position compressing the seal to watertight configuration.

2. The appliance latch of claim 1 further including a latch control circuitry providing a pulse to the electromagnet to release the door upon receipt by the latch control circuitry of a release signal wherein the latch control circuitry provides a series of pulses to the electromagnet each pulse sufficient in duration to permit release of the latch.

3. The appliance latch of claim 1 wherein the handle is activated by movement of the handle to activate an electrical switch.

4. The appliance latch of claim 1 wherein the handle is activated by a grasping of the handle by a user and a sensing of the grasping.

5. The appliance latch of claim 1 further including a cycle timer energizing the electromagnet at a predetermined time in an appliance cycle.

6. The appliance latch of claim 1 wherein the motorized door closure mechanism includes a force sensor and wherein the electromagnet is energized by the motorized door closure mechanism when a force of predetermined magnitude is sensed.

7. The appliance latch of claim 1 wherein at least one of the pole face and ferromagnetic strike is attached by a gimbal to one of a respective door and housing.

8. The appliance latch of claim 1 wherein the magnetic attractor comprises at least one L-shaped pole having a first leg aligned with an axis of closing of the door to the housing and a second leg perpendicular thereto along which the permanent magnet and electromagnet are arrayed such that one pole of the permanent magnet abuts a face of the L-shaped pole in the electromagnet is wrapped around the L-shaped pole.

9. The appliance latch of claim 1 wherein the magnetic attractor comprises two ferromagnetic pole straps sandwiching the permanent magnet so that one strap abuts a north pole of the permanent magnet and one strap abuts a south pole of the permanent magnet.

10. The appliance latch of claim 1 wherein the ferromagnetic strike is mounted on the door and the magnetic attractor is mounted in the housing.

11. The appliance latch of claim 1 wherein the ferromagnetic strike is mounted on the housing and the magnetic attractor is mounted in the door.

12. A dishwasher comprising:

a door;

an elastomeric compression seal;

a housing with an opening closable by the door against the elastomeric seal to seal dishwashing water within the housing when the door is in a closed position, the elastomeric seal exerting an opening force on the door when so sealed;

a magnetically attractable strike attached to one of the housing and the door;

a permanent magnet attached to an other of the housing and door to magnetically retain the magnetically attractable strike with the permanent magnet when the door is in the closed position, a force of attraction between the permanent magnet and the magnetically attractable strike being greater than the opening force exerted by the elastomeric seal on the door; and an electromagnet positioned to counteract the permanent magnet and release the magnetically attractable strike when the electromagnet is energized;

a motorized door closure mechanism attached to one of the housing and the door and to one of the magnetically attractable strike and permanent magnet to move the one of the magnetically attractable strike and permanent magnet to an extended position whereby the permanent magnet may be magnetically attached to the magnetically attractable strike before substantial compression of the seal and to move the magnetically attached permanent magnet and magnetically attractable strike to a retracted position compressing the seal to watertight configuration; and a mechanical bias element opening the door to a vent position allowing drying of dishes when the magnetically attractable strike is released.

13. The dishwasher of claim 12 wherein the mechanical bias element includes a spring for opening the door to the vent position and a detent for releasably holding the door at the vent position.

14. The dishwasher of claim 12 further including a handle attached to the door and grippable by a user; and an electronic switch dectecting operation of the handle to provide a signal to the electronic latch releasing the door.

15. The dishwasher of claim 14 wherein the switch includes a sensor detecting presence of a user's hand on the handle in an attitude for opening of the door without movement of the handle to provide a signal to the electronic latch releasing the door.

16. The appliance of claim 15 wherein the electronic sensor is selected from the group consisting of: a capacitive sensor, a conductivity sensor, inductive senor, and a photo sensor.

17. In a dishwasher having a housing with an opening closable by a door and sealed by an elastomeric compression seal positioned between the door and housing to provide a watertight seal therebetween, a latch comprising:

a ferromagnetic strike attached to one of the housing and the door;

a magnetic attractor attached to an other of the housing and door and having a pole face abutting the ferromagnetic strike when the door is closed against the housing and against the force of the elastomeric seal, the ferromagnetic strike and magnetic attractor positioned with respect to the elastomeric compression seal so that the seal is fully compressed as the magnetic attractor and ferromagnetic strike abut;

a permanent magnet magnetically communicating with the pole face and having sufficient magnetic strength without augmentation by an electromagnetic pulse to magnetically retain the ferromagnetic strike against the pole face against a predetermined force of opening greater than a force of the seal toward opening the door; and wherein at least one of the pole face and ferromagnetic strike is attached by a gimbal to one of a respective door and housing;

an electromagnetic coil communicating with the pole face to provide a magnetic pulse counteracting the retention of the ferromagnetic strike by the permanent magnet when activated;

a sensor actuatable by a user to provide an electrical signal to open the door; and latch control circuitry responding to the electrical signal to providing at least one pulse to the electromagnetic coil to activate the electromagnetic coil to release the door by counteracting the retention of the ferromagnetic strike by the permanent magnet.

18. In a dishwasher having a housing with an opening closable by a door and sealed by an elastomeric compression seal positioned between the door and housing to provide a watertight seal therebetween, a latch comprising:

a ferromagnetic strike attached to one of the housing and the door;

a magnetic attractor attached to an other of the housing and door and having a pole face abutting the ferromagnetic strike when the door is closed against the housing and against the force of the elastomeric seal;

a permanent magnet magnetically communicating with the pole face and having sufficient magnetic strength without augmentation by an electromagnetic pulse to magnetically retain the ferromagnetic strike against the pole face against a predetermined force of opening greater than a force of the seal toward opening the door; and wherein at least one of the pole face and ferromagnetic strike is attached by a gimbal to one of a respective door and housing;

an electromagnetic coil communicating with the pole face to provide a magnetic pulse counteracting the retention of the ferromagnetic strike by the permanent magnet wherein the magnetic attractor comprises at least two poles having legs aligned with an axis of closing of the door to the housing and in which the permanent magnet bridges the two legs and electromagnet coil is wrapped about one of the poles displaced from the magnet.

* * * * *

UNITED STATES PATENT AND TRADEMARK OFFICE

CERTIFICATE OF CORRECTION

PATENT NO. : 7,654,590 B2
APPLICATION NO. : 11/325162
DATED : February 2, 2010
INVENTOR(S) : Kenyon A. Hapke It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 399 days.

Signed and Sealed this

Twenty-third Day of November, 2010

David J. Kappos

David J. Kappos
*Director of the United States Patent and Trademark Office*